US009222294B2

(12) United States Patent
Chen

(10) Patent No.: US 9,222,294 B2
(45) Date of Patent: Dec. 29, 2015

(54) MOVEMENT RESTRICTING APPARATUS FOR A SLIDE ASSEMBLY

(71) Applicant: SLIDE MEI YAO INTERNATIONAL CO., LTD., New Taipei (TW)

(72) Inventor: Tsung-Yao Chen, New Taipei (TW)

(73) Assignee: Slide Mei Yao International Co., Ltd., New Taipei (TW)

( * ) Notice: Subject to any disclaimer, the term of this patent is extended or adjusted under 35 U.S.C. 154(b) by 0 days.

(21) Appl. No.: 14/283,435

(22) Filed: May 21, 2014

(65) Prior Publication Data

US 2014/0352109 A1 Dec. 4, 2014

(30) Foreign Application Priority Data

May 28, 2013 (TW) ..... 102118770 A

(51) Int. Cl.
*A47B 88/04* (2006.01)
*E05D 15/06* (2006.01)

(52) U.S. Cl.
CPC ..... *E05D 15/0621* (2013.01); *A47B 88/0477* (2013.01); *Y10T 16/361* (2015.01)

(58) Field of Classification Search
CPC ..... A47B 88/04; A47B 88/0477; A47B 88/0481; A47B 88/0055
USPC ..... 312/330.1, 333, 334.1, 334.8, 334.6, 312/334.14, 334.27, 334.44, 334.47, 319.1, 312/348.4
See application file for complete search history.

(56) References Cited

U.S. PATENT DOCUMENTS

| | | | | |
|---|---|---|---|---|
| 6,116,485 | A * | 9/2000 | Watkins | 224/275 |
| 7,758,134 | B2 * | 7/2010 | Huang | 312/334.47 |
| 8,256,853 | B2 * | 9/2012 | Chen et al. | 312/333 |
| 2004/0000852 | A1 * | 1/2004 | Lam Harn et al. | 312/348.4 |
| 2009/0058242 | A1 * | 3/2009 | Holcomb | 312/334.29 |
| 2013/0147335 | A1 * | 6/2013 | Chung | 312/334.47 |

* cited by examiner

*Primary Examiner* — James O Hansen
(74) *Attorney, Agent, or Firm* — Rosenberg, Klein & Lee

(57) ABSTRACT

A movement restricting apparatus includes a track unit with a guide track that has a non-limit path and a limit path, and a restricting unit with a pin unit that has a pin portion. The pin portion is swingably inserted into the guide track. The pin portion and the guide track make relative movement when a moving unit moves relative to a stationary unit. The relative movement of the pin portion and the guide track is guided by the limit path when the moving unit moves in a first direction and is guided by the non-limit path when the moving unit moves in a second direction opposite to the first direction.

6 Claims, 15 Drawing Sheets

MOVEMENT RESTRICTING APPARATUS FOR A SLIDE ASSEMBLY

CROSS-REFERENCE TO RELATED APPLICATION

This application claims priority to Taiwanese Application No. 102118770, filed on May 28, 2013.

BACKGROUND OF THE INVENTION

1. Field of the Invention

The invention relates to a movement restricting apparatus for a slide assembly, and more particularly to a movement restricting apparatus that is adapted to guide movement of a moving unit relative to a stationary unit of a slide assembly.

2. Description of the Related Art

In order to smoothly slide a moving unit into or out of a cabinet, a pair of sliding rail units are generally and respectively disposed between two opposite sides of the moving unit and the cabinet. Each of the sliding rail units has two or three sliding rails that are engaged with each other and that are slidable relative to each other. The moving unit includes a moving carrier member disposed in the cabinet. The moving carrier member has a front plate.

Operation of the sliding rail units may involve a mechanical-type design or an electrical-type design for opening or closing the moving unit relative to the cabinet. For the mechanical-type design, some may involve pushing the front plate to eject the moving unit. Others may involve decelerating the sliding speed of the moving unit to avoid noise caused by collision of the moving unit with the cabinet. U.S. Pat. No. 5,040,833 and Taiwanese Patent Publication No. 201242540 disclose an improvement of the mechanical-type design for the push-to-eject operation. However, after the push-to-eject operation for opening the moving unit, failure movement of the moving unit may be caused by a lack of a rectilinear movement between the moving units and the cabinet. In addition, when a closing operation is applied on the moving unit, the moving unit may tend to stay at a push-to-eject position before completely closing the moving unit.

SUMMARY OF THE INVENTION

Therefore, an object of the present invention is to provide a movement restricting apparatus for a slide assembly that can overcome the aforesaid drawbacks of the prior art.

According to one aspect of the present invention, a movement restricting apparatus is for installation in a slide assembly, which includes a stationary unit and a moving unit that is movable relative to the stationary unit. The movement restricting apparatus includes a track unit, a restricting unit and a biasing unit.

The track unit is adapted to be connected to one of the stationary unit and the moving unit, and includes a longitudinal guide track, a front lock piece, a front eject piece proximate to the front lock piece, and a deflection block disposed between the front lock piece and the front eject piece. The guide track has a non-limit path, a limit path, and a turning region. The front lock piece and the front eject piece are disposed at a junction of the non-limit path and the limit path. The front lock piece has a hook recess proximate to the front eject piece. The turning region is disposed between the front lock piece and the deflection block.

The restricting unit is adapted to be connected to the other one of the stationary unit and the moving unit, and includes an adjustment casing, a pin seat connected to the adjustment casing, and a pin unit pivotally mounted to the pin seat. The pin unit has a pin portion that is inserted swingably into the guide track.

The biasing unit has a resilient member adapted to be disposed between the stationary unit and the moving unit.

The pin portion and the guide track make relative movement when the moving unit moves relative to the stationary unit. The relative movement of the pin portion and the guide track is guided unidirectionally by the limit path when the moving unit is moved by an external force in a first direction, and is guided by the non-limit path when the moving unit is urged by the biasing unit to move unidirectionally in a second direction opposite to the first direction.

When the relative movement of the pin portion and the guide track is guided by the limit path, the pin portion is engageable with the guide track to stop the relative movement of the pin portion and the guide track as soon as the direction of the relative movement of the pin portion and the guided track reverses due to a biasing force of the biasing unit upon removal of the external force that moves the moving unit in the first direction.

When the moving unit is once again subjected to the external force, the relative movement of the pin portion and the guide track continues in the limit path until the pin portion leaves the limit path and is guided into the turning region by the deflection block. When the external force is removed once again, the moving unit is subjected to the reverse biasing force of the biasing unit, and the pin portion is engaged in the hook recess of the front lock piece. When the moving unit is subjected to the external force once again, the pin portion is ejected from the hook recess into the non-limit path by the front eject piece. When the external force is removed once again, the pin portion enters the non-limit path and the relative movement between the pin portion and the guide track is driven unidirectionally by the reverse biasing force of the biasing unit.

According to another aspect of the present invention, a movement restricting apparatus is for installation between a stationary unit and a moving unit that is movable relative to the stationary unit, and includes a restricting unit.

The restricting unit includes an adjustment casing, a pin seat that is adjustably connected to the adjustment casing, and a pin unit that is pivotally mounted to the pin seat.

According to a further aspect of the present invention, a movement restricting apparatus is for installation between a stationary unit and a moving unit that is movable relative to the stationary unit. The movement restricting apparatus includes a track unit and a restricting unit.

The track unit includes a longitudinal guide track that has a non-limit path and a limit path. The non-limit path and the limit path are spaced apart from each other and extend longitudinally of the guide track. The track unit further includes at least one limit block and at least one auxiliary block.

The at least one limit block is disposed between the non-limit path and the limit path.

The at least one auxiliary block is disposed between the non-limit path and the limit path in proximity to the at least one limit block. The at least one limit block and the at least one auxiliary block extend convergingly to each other to cooperatively define a restriction space therebetween.

The restricting unit includes a swingable pin unit that has a pin portion inserted swingably into the track unit.

The pin portion and the guide track make relative movement when the moving unit is moved relative to the stationary unit. The relative movement of the pin portion and the guide track is guided by the limit path when the moving unit is moved by an external force in a first direction, and is guided by the non-limit path when the moving unit is moved by a reverse force in a second direction opposite to the first direction.

When the relative movement of the pin portion and the guide track is guided by the limit path, the pin portion is engageable with the restriction space to stop the relative movement of the pin portion and the guide track as soon as the direction of the relative movement of the pin portion and the guided track starts to reverse due to the reverse force upon removal of the external force that moves the moving unit in the first direction.

According to still another aspect of the present invention, a movement restricting apparatus is for installation on a stationary rail member and a sliding rail member. The movement restricting apparatus includes a track unit, a restricting unit and a biasing unit.

The track unit includes a longitudinal guide track, a front lock piece, a front eject piece proximate to the front lock piece, and a deflection block disposed between the front lock piece and the front eject piece. The guide track has a non-limit path, a limit path, and a turning region. The front lock piece and the front eject piece are disposed at a junction of the non-limit path and the limit path. The front lock piece has a hook recess proximate to the front eject piece. The turning region is disposed between the front lock piece and the deflection block.

The restricting unit is movable relative to the track unit, and includes a pin seat and a pin unit that is pivotally mounted to the pin seat. The pin unit has a pin portion that is inserted swingably into the track unit.

The biasing unit has a resilient member adapted to be disposed between the stationary rail member and the sliding rail member.

The pin portion and the guide track make relative movement when the sliding rail member moves relative to the stationary rail member. The relative movement of the pin portion and the guide track is guided unidirectionally by the limit path when the sliding rail member is moved by an external force in a first direction, and is guided by the non-limit path when the sliding rail member is urged by the resilient member to move unidirectionally in a second direction opposite to the first direction.

When the relative movement of the pin portion and the guide track is guided by the limit path, the pin portion is engageable with the guide track to stop the relative movement of the pin portion and the guide track as soon as the direction of the relative movement of the pin portion and the guided track reverses due to a reverse biasing force of the biasing unit upon removal of the external force that moves the sliding rail member in the first direction.

When the sliding rail member is once again subjected to the external force, the relative movement of the pin portion and the guide track continues in the limit path until the pin portion leaves the limit path and is guided into the turning region by the deflection block. When the external force is removed once again, the sliding rail member is subjected to the reverse biasing force of the biasing unit, and the pin portion is engaged in the hook recess of the front lock piece. When the sliding rail member is subjected to the external force once again, the pin portion is ejected from the hook recess into the non-limit path by the front eject piece. When the external force is removed once again, the pin portion enters the non-limit path and the relative movement between the pin portion and the guide track is driven unidirectionally by the reverse biasing force of the resilient member.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
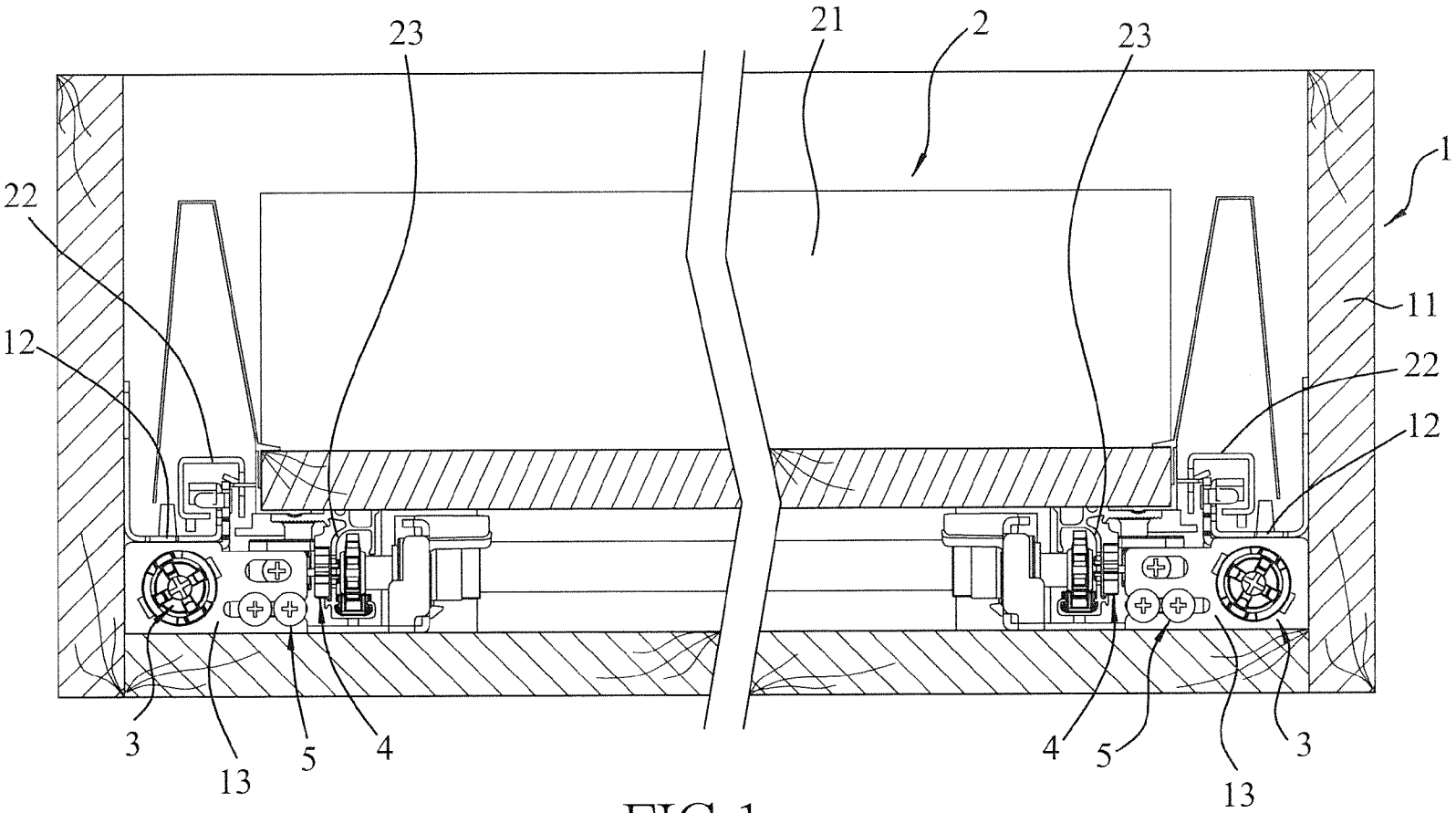
FIG. 1 is a fragmentary schematic front sectional view illustrating a slide assembly incorporating the first preferred embodiment of a movement restricting apparatus according to the present invention.

Before the present invention is described in greater detail, it should be noted that like elements are denoted by the same reference numerals throughout the disclosure.

Figure 2:
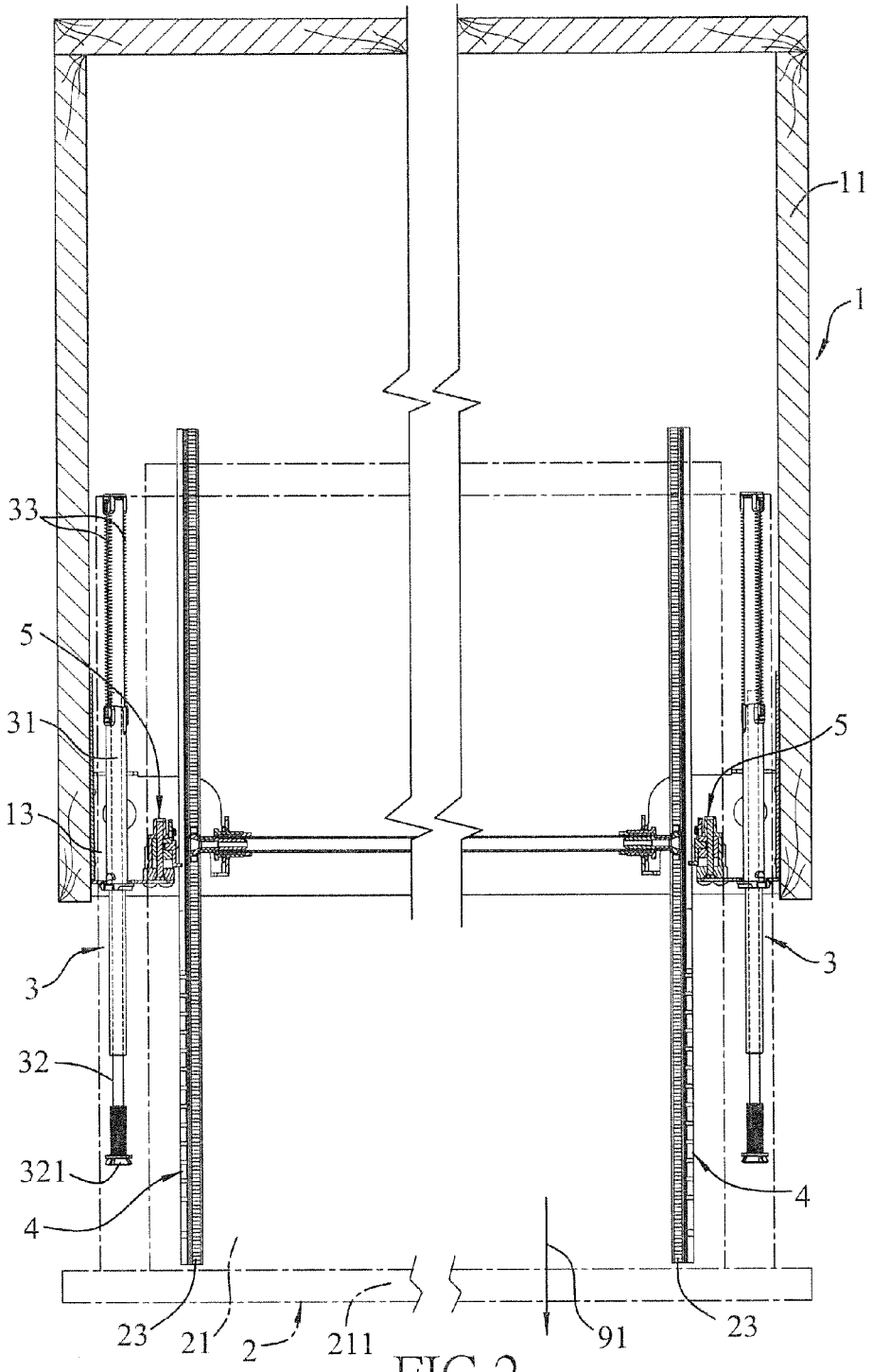
FIG. 2 is a fragmentary schematic top sectional view illustrating a moving unit of the slide assembly in an open state.
Figure 3:
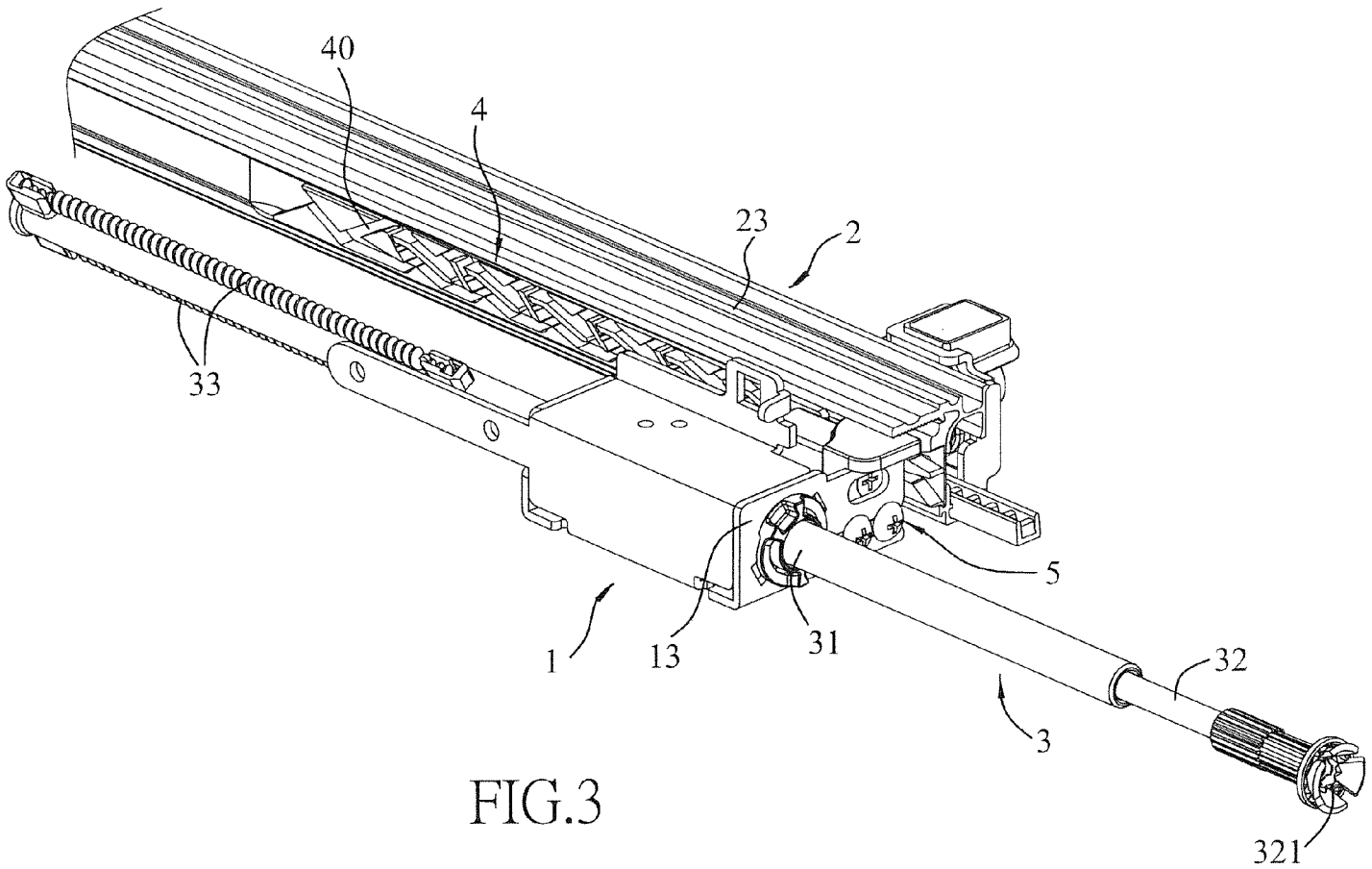
FIG. 3 is a fragmentary perspective view of the first preferred embodiment.

Referring to FIGS. 1 to 3, the first preferred embodiment of a movement restricting apparatus according to the present invention is illustrated and is adapted to be installed in a slide assembly. The slide assembly includes a stationary unit 1 and a moving unit 2 that is movable relative to the stationary unit 1. The stationary unit 1 includes a cabinet body 11, two opposite stationary rail members 12 that are respectively mounted on left and right sides of the cabinet body 11, and two opposite connection members 13. Each of the connection members 13 is connected to and extends from a corresponding one of the stationary rail members 12 in a direction toward the other one of the stationary rail members 12.

The moving unit 2 includes a carrier member 21 that is slidably disposed in the cabinet body 11 for receiving objects, two first sliding rail members 22 that are respectively connected to left and right outer sides of the carrier member 21 and that are respectively slidable relative to the stationary rail members 12, and two second sliding rail members 23 that are connected to two opposite sides of a bottom wall of the carrier member 21 and that are respectively proximate to the connection members 13. The carrier member 21 has a front plate 211. When the front plate 211 is pressed to eject the carrier member 21 out from the cabinet body 11, the second sliding rail members 23 are respectively driven to slide relative to the respective connection members 13, and to thereby guide and support the carrier member 21 such that the carrier member 21 moves smoothly relative to the cabinet body 11. In this preferred embodiment, a drawer is used as an example of a slide assembly installed with the movement restricting apparatus according to the present invention. However, the present invention should not be limited in this respect. For example, the movement restricting apparatus according to the present invention may be applied to any slide assembly, such as a door panel, a window, an article of furniture, etc., that has a slide to move along a single-rail system and that needs to be stopped instantaneously during movement thereof. Since the feature of this invention does not reside in the configuration of the stationary rail members 12, the first sliding rail members 22, the second sliding rail members 23, the stationary unit 1 and the moving unit 2, which are well known in the art, details of the same are omitted herein for the sake of the brevity.

Figure 4:
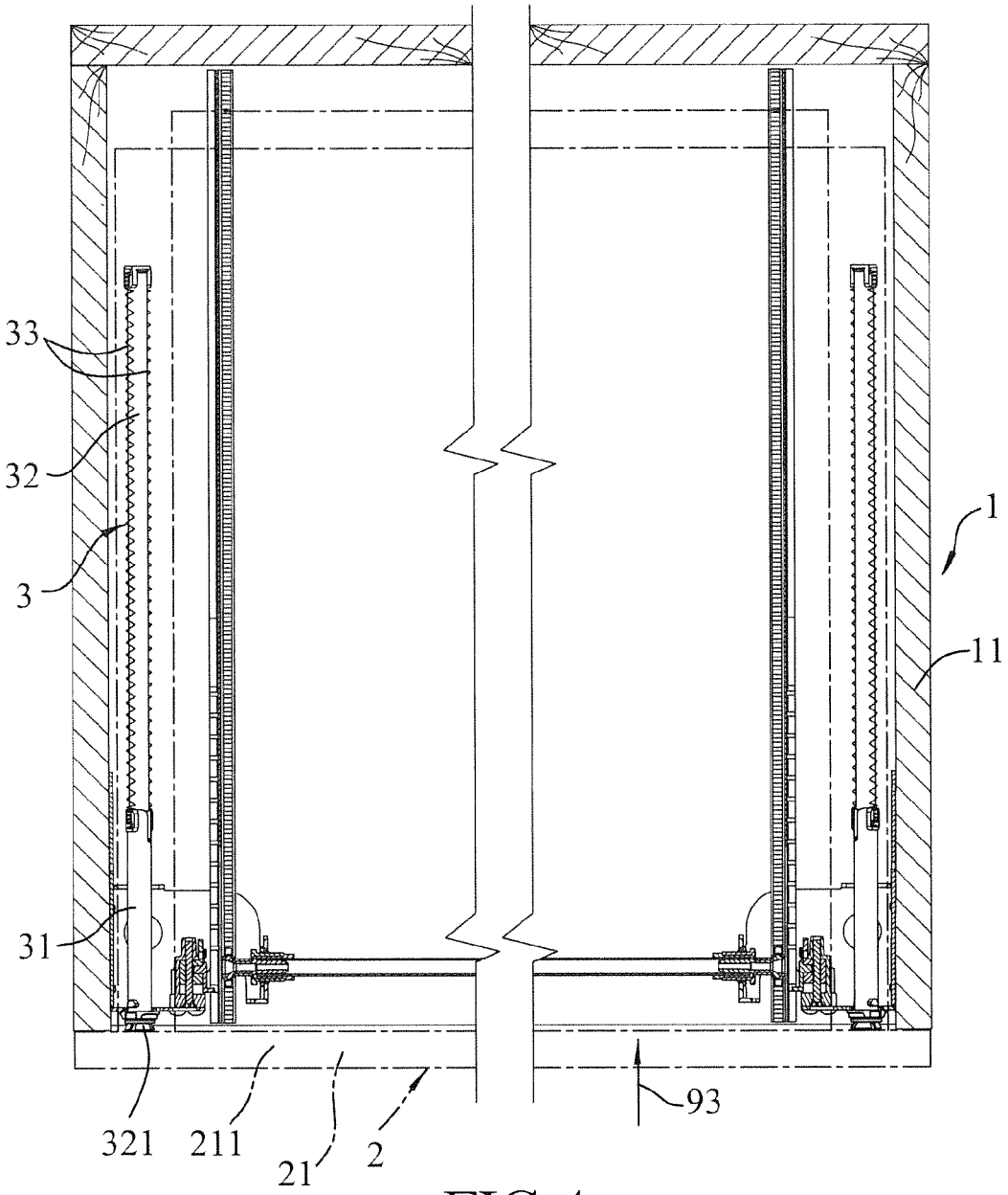
FIG. 4 is a fragmentary schematic top sectional view illustrating the moving unit of the slide assembly in a closed state.

In this preferred embodiment, two movement restricting apparatuses according to the present invention are disposed respectively between left sides of the moving unit 2 and the stationary unit 1 and between right sides of the moving unit 2 and the stationary unit 1. Each movement restricting apparatus includes a track unit 4 adapted to be connected to the moving unit 2, a restricting unit 5 adapted to be connected to the stationary unit 1, and a biasing unit 3 connected to the track unit 4 and the restricting unit 5. The biasing unit 3 includes a sleeve 31 mounted on a corresponding one of the connection members 13 of the stationary unit 1 and extending in a front-rear direction, a push rod 32 movably inserted into the sleeve 31 to move in a lengthwise direction of the sleeve 31, and two resilient members 33. Each of the resilient members 33 interconnects rear ends of the sleeve 31 and of the push rod 32. The push rod 32 has a push end portion 321 that extends forwardly and outwardly from the sleeve 31 and that faces toward the front plate 211. In this preferred embodiment, each of the resilient members 33 is a tension spring. The number of the resilient members 33 may vary depending on requirements. According to another preferred embodiment, each resilient member 33 may be configured as a compression spring as long as the resilient member 33 can provide a spring force to move the moving unit 2 from a closed position to an opened position when the front plate 211 is pressed. As shown in FIG. 4, when the moving unit 2 is moved rearwardly to the closed position, since the front plate 211 contacts and presses the push end portions 321 of the push rods 32, the push rods 32 are moved rearwardly and are retracted into the respective sleeves 31, and the resilient members 33 are stretched and thus have a restoring force.

Figure 5:
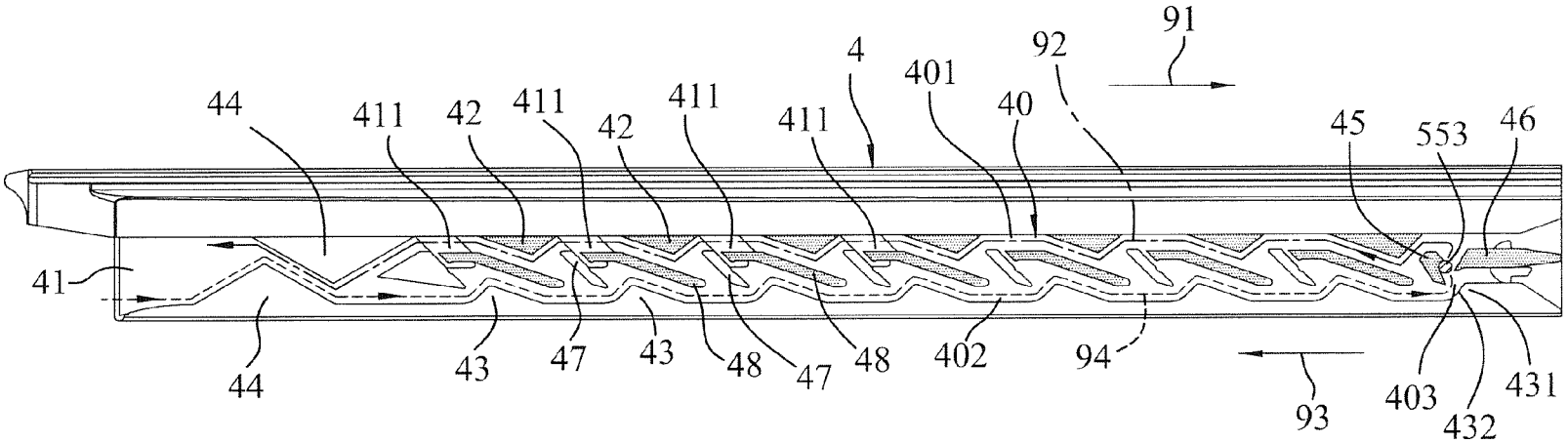
FIG. 5 is a fragmentary schematic side view illustrating the track unit of the first preferred embodiment.

Referring to FIGS. 3 and 5, the track unit 4 of each movement restricting apparatus of the present invention is mounted in a corresponding one of the second sliding rail members 23 of the moving unit 2. In this preferred embodiment, the track unit 4 includes a longitudinal base wall 41 that extends in a front-rear direction of the moving unit 2 and that has upper and lower longitudinal sides, a plurality of spaced apart upper guide pieces 42 that are disposed in a row along the upper longitudinal side of the longitudinal base wall 41 and that project from the base wall 41, and a plurality of spaced apart lower guide pieces 43 that are disposed in a row along the lower longitudinal side of the longitudinal base wall 41 and that project from the base wall 41. In addition, the track unit 4 includes a plurality of limit blocks 47, a plurality of auxiliary blocks 48, two upper and lower rear end pieces 44, a front lock piece 45, a front eject piece 46, and a deflection block 431. The limit blocks 47 and the auxiliary blocks 48 are disposed on the base wall 41 in a space between the rows of the upper and lower guide pieces 42, 43. The two upper and lower rear end pieces 44 are disposed rearwardly of the upper and lower guide pieces 42, 43, and are staggered along a top-bottom direction of the base wall 41. The front lock piece 45 is disposed in front of a space between the rows of the upper and lower guide pieces 42, 43. The front eject piece 46 is disposed in front of the front lock piece 45. The deflection block 431 is disposed in front of the lower guide pieces 43 and is spaced below the front eject piece 46. In this preferred embodiment, the auxiliary blocks 48 are equal in number to the limit blocks 47. However, the number of the limit blocks 47 or the auxiliary blocks 48 may vary. Each auxiliary block 48 is disposed in front of an adjacent one of the limit blocks 47 in this embodiment.

Figure 6:
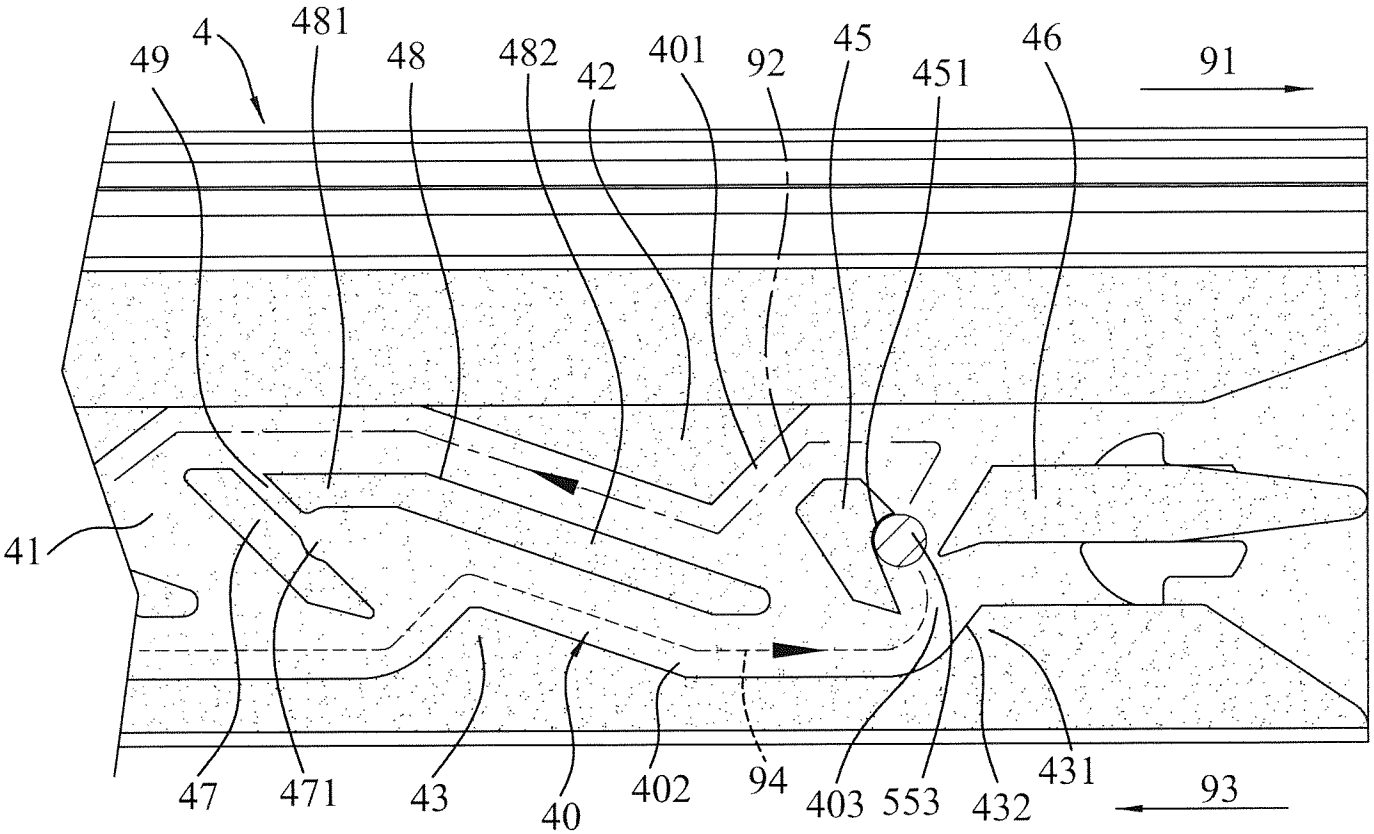
FIG. 6 is an enlarged view of a portion of the track unit of the first preferred embodiment shown in FIG. 5, illustrating the position of a pin portion of a pin unit of the first preferred embodiment when the moving unit is in the closed state.
Figure 7:
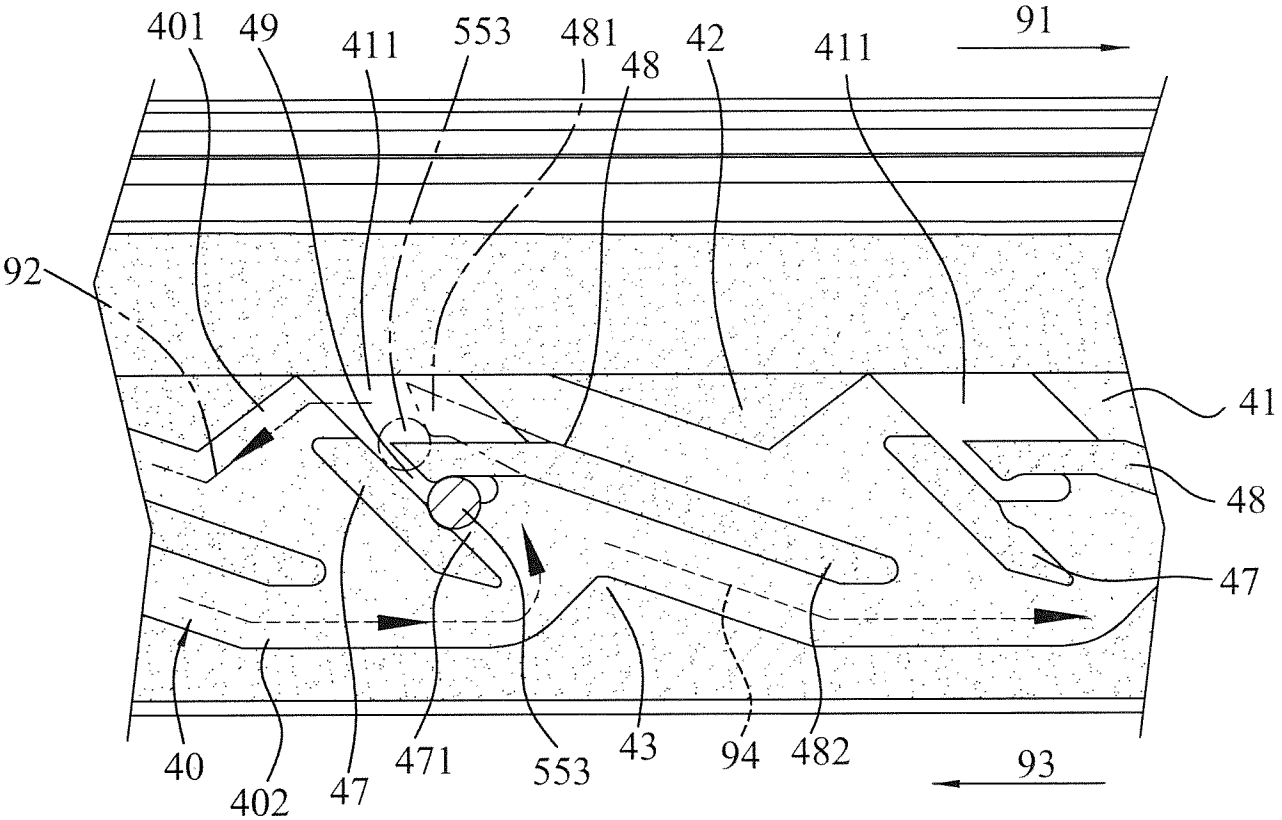
FIG. 7 is the same view as FIG. 6, but illustrating the position of the pin portion of the pin unit when the moving unit is in a half-closed state.
Figure 8:
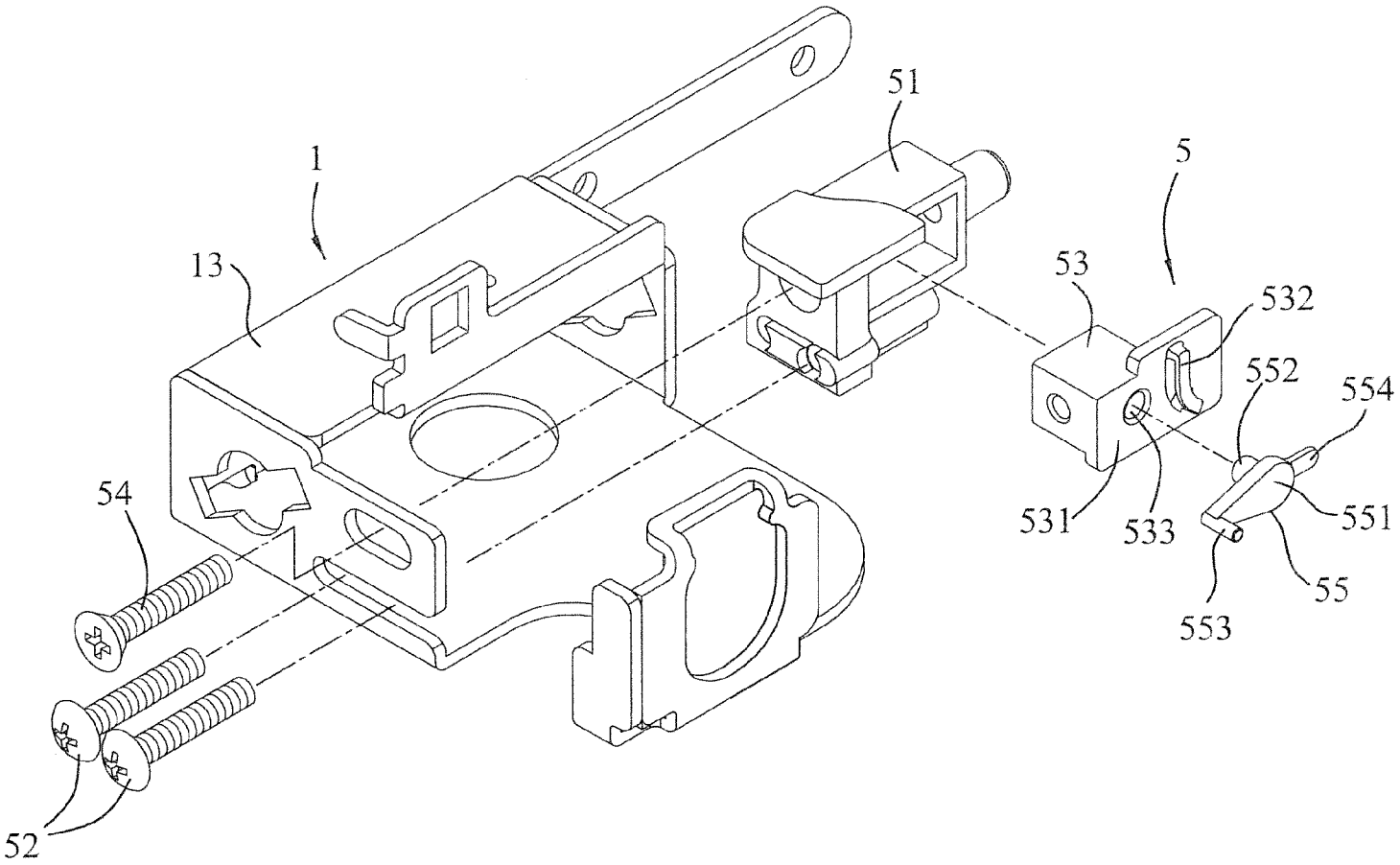
FIG. 8 is an exploded perspective view illustrating the restricting unit of the first preferred embodiment.
Figure 9:
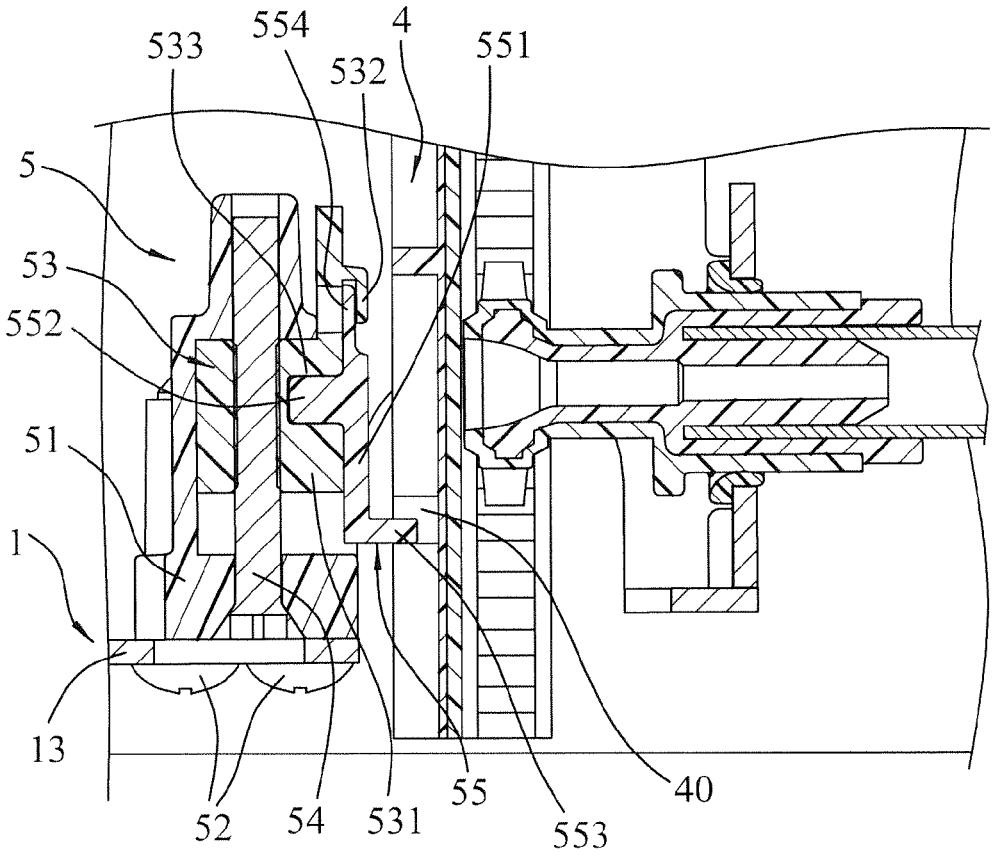
FIG. 9 is a fragmentary schematic top sectional view illustrating a portion of the drawer incorporating the first preferred embodiment.

Referring to FIGS. 5 to 7, the base wall 41 further has a plurality of hollow portions 411 respectively corresponding in position to some of the auxiliary blocks 48 that are located in a rear part of the base wall 41. The upper guide pieces 42 and the upper rear end piece 44 are configured in a substantially triangular shape and have apex portions that extend toward an intermediate part of the base wall 41 between the lower and upper longitudinal sides of the base wall 41. The lower guide pieces 43 and the lower rear end piece 44 are configured in a substantially triangular shape and have apex portions that extend toward the intermediate part of the base wall 41 between the upper and lower longitudinal sides of the base wall 41. The front lock piece 45 has a hook recess 451 that faces toward the front eject piece 46. The deflection block 431 has a curved surface 432 that is spaced below the hook recess 451 and that is anterior to the hook recess 451. Each of the limit blocks 47 and the corresponding one of the auxiliary blocks 48 extend convergingly to each other to cooperatively define a restriction space 471 therebetween. In this preferred embodiment, the restriction space 471 is able to receive a pin portion 553 of a pin unit 55 (which will be detailed hereinafter) so as to restrain a reverse movement of the pin portion 553 of the pin unit 55. One surface of each of the limit blocks 47 contiguous to the restriction space 471 is indented to form an indentation so that the restriction space 471 extends to the indentation. However, the surface of the limit block 47 may not be indented, and the indentation may be dispensed with according to another embodiment of the invention. Each of the auxiliary blocks 48 has a resilient portion 481 that extends in the front-rear direction in proximity to the corresponding one of the limit blocks 47 and that is disposed immediately above the restriction space 471, and a lengthened portion 482 that extends from the resilient portion 481 in a direction away from the corresponding one of the limit blocks 47 and the converging end of the restriction space 471. The lengthened portion 482 protrudes from the base wall 41. The resilient portions 481 of some auxiliary blocks 48 which are located adjacent the respective hollow portions 411 in the rear part of the base wall 41 extend floatingly over the respective hollow portions 411 and are therefore resilient. As shown in FIG. 7, each limit block 47 cooperates with an adjacent one of the auxiliary blocks 48 to define an evading gap 49 that communicates with the converging end of the restriction space 471. Specifically, a rear end of each of the resilient portions 481 defines the evading gap 49 with the adjacent one of the limit blocks 47. A width of the evading gap 49 is smaller than that of the pin portion 553 of the pin unit 55.

It should be noted that two adjacent limit block 47 and auxiliary block 48 are disposed immediately below a junction of two adjacent upper guide pieces 42. Each of the lower guide pieces 43 is disposed immediately below a space between two adjacent limit block 47 and auxiliary block 48.

Each of the track units 4 further includes a longitudinal guide track 40 that is defined on the longitudinal base wall 41 by the upper and lower guide pieces 42, 43, the lower rear end piece 44, the front lock piece 45, the front eject piece 46, the deflection block 431, the limit blocks 47, and the auxiliary blocks 48, and that has a non-limit path 401 proximate to the upper longitudinal side of the base wall 41, a limit path 402 proximate to the lower longitudinal side of the base wall 41, and a turning region 403 formed between the front lock piece 45 and the curved surface 432 of the deflection block 431. The non-limit path 401 and the limit path 402 are spaced apart from each other and extend longitudinally of the guide track 40. Each of the limit blocks 47 is disposed between the non-limit path 401 and the limit path 402. Each of the auxiliary blocks 48 is disposed between the non-limit path 401 and the limit path 402 in proximity to the corresponding one of the limit blocks 47. In this preferred embodiment, the non-limit path 401 is formed below the upper guide pieces 42 and above the limit blocks 47 and the auxiliary blocks 48. The limit path 402 is formed above the lower guide pieces 43 and below the limit blocks 47 and the auxiliary blocks 48.

Referring to FIGS. 1 to 3, 8 and 9, the restricting units 5 are adapted to be connected to the stationary unit 1. In this preferred embodiment, each restricting unit 5 includes an adjustment casing 51, a pin seat 53 that is adjustably connected to the adjustment casing 51, and the pin unit 55 that is pivotally mounted to the pin seat 53. Preferably, each of the restricting units 5 further includes two mounting screws 52 that connect the adjustment casing 51 to a corresponding one of the connection members 13 of the stationary unit 1, and an adjusting screw 54 that is connected to the adjustment casing 51 and the pin seat 53 to adjust the position of the pin seat 53 relative to the adjustment casing 51. In this preferred embodiment, the pin unit 55 is a swingable pin unit that is swingably mounted to the pin seat 53 and that extends movably into the longitudinal guide track 40 of a corresponding one of the track units 4.

The pin seat 53 has a side wall 531 that is adjacent to the track unit 4, that has a pivot hole 533 and that has a retainer part 532 to prevent the pin unit 55 from being released from the pin seat 53. The retainer part 532 extends curvedly and downwardly between top and bottom of the side wall 531. In this preferred embodiment, the adjusting screw 54 is rotatably connected to the adjustment casing 51 and is threadedly connected to the pin seat 53. As a result, the adjusting screw 54 is rotatable to move the pin seat 53 forward or rearward relative to the adjustment casing 51. The pin unit 55 has a plate portion 551, a connection spindle 552 that protrudes from the plate portion 551 and that is pivotally inserted into the pivot hole 533, a limit portion 554 that extends from one lateral end of the plate portion 551 to engage movably the retainer part 532 of the side wall 531, and a pin portion 553 that protrudes from another lateral end of the plate portion 551. In this preferred embodiment, the retainer part 532 limits the limit portion 554 from being released from the pin seat 53. The pin portion 553 is swingably inserted into the guide track 40 and is able to move relative to the guide track 40.

With reference to FIGS. 2, 3, 8 and 9, the adjusting screws 54 of the restricting units 5 of the movement restricting apparatuses may be operated to adjust the positions of the pin units 55 of the restricting units 5, when the track units 4 are not installed symmetrically on left and right sides of the moving unit 2, and/or when the restricting units 5 are not installed symmetrically on left and right sides of the stationary unit 1. For example, when one of the track units 4 disposed at the left side is more forward or rearward than the other one of the track units 4 disposed at the right side, the pin portions 553 of the pin units 55 at left and right sides may be unable to be inserted accurately into the restriction spaces 471 of the respective guide tracks 40 for synchronously positioning the pin units 55. By rotating the adjusting screw 54 to move forward or rearward the pin seat 53 relative to the adjusting casing 51, the pin portion 553 of the pin unit 55 is able to extend accurately into the guide track 40 for each of the left and right sides, and the two movement restricting apparatuses can thus operate synchronously. According to other embodiments, the track unit 4 and the restricting unit 5 may be interchanged in position. In other words, the track units 4 may be connected to the stationary unit 1, and the restricting units 5 may be connected to the respective second sliding rail members 23 of the moving unit 2.

With reference to FIGS. 2, 3 and 5, in actual use, when the moving units 2 are moved relative to the stationary unit 1, the track units 4 are moved relative to the restricting units 5. In FIG. 5, the routes of the relative movements between the pin portion 553 of the pin unit 55 and the guide track 40 are illustrated using phantom lines 92 and dotted lines 94. When the track unit 4 is moved forwardly in a direction indicated by arrow 91 to place the moving unit 2 in an open position, the relative movement of the pin portion 553 and the guide track 40 is guided by the non-limit path 401 and is directed along the route shown by the phantom lines 92. In this state, the relative movement of the pin portion 553 is rearward and is unidirectional. When the track unit 4 is moved rearwardly in a direction indicated by arrow 93 to place the moving unit 2 in a closed position, the relative movement of the pin portion 553 and the guide track 40 is guided by the limit path 402 and is directed along the route shown by the dotted lines 94. In this state, the relative movement of the pin portion 553 is forward and is unidirectional.

With reference to FIG. 4, the carrier member 21 of the moving unit 2 is received completely inside the cabinet body 11 of the stationary unit 1 in the closed position, and the biasing unit 3 has a restoring force. Referring to FIG. 6, the relative movement of the pin portion 553 is made unidirectionally in the limit path 402 until the pin portion 553 leaves the limit path 402 and is guided into the turning region 403 by the curved surface 432 of the deflection block 431 when an external force is applied to push and close the moving unit 2. When the external force is removed from the moving unit 2, the moving unit 2 is subjected to the reverse restoring force of the biasing unit 3, and the pin portion 553 is deflected into and is stopped by the hook recess 451, thereby placing the moving unit 2 in the closed position. When the carrier member 21 is to be opened, a user may press the front plate 211 of the carrier member 21. In such a way, the front eject piece 46 pushes and ejects the pin portion 553 from the hook recess 451. When the front plate 211 is released, the restoring force of the basing unit 3 ejects the moving unit 2 from the stationary unit 1, and the relative movement of the pin portion 553 is guided by the non-limit path 401. As shown in FIGS. 2 and 6, the moving unit 2 is moved in the direction indicated by arrow 91 until it reaches the fully opened position.

Referring back to FIGS. 4 and 5, when the carrier member 21 is to be closed, the user may apply an external force to push the moving unit 2 such that the moving unit 2 moves rearwardly in the direction indicated by arrow 93 (referred to as the first direction 93 hereinafter) to the closed position. Since the front plate 211 pushes the push rod 32, the resilient members 33 store the restoring force thereof. At the same time, the track unit 4 moves rearwardly together with the moving unit 2, and the relative movement of the pin portion 553 and the guide track 40 is guided by the limit path 402. When the external force is removed, the restoring force of the resilient members 33 pushes the push rod 32 to move the front plate 211 so that the moving unit 2 is subjected to the restoring force of the resilient members 33, i.e., a reverse force that moves the moving unit 2 and the track unit 4 forwardly in the direction indicated by arrow 91 (referred to as a second direction 91 hereinafter) opposite to the first direction 93. As shown in FIG. 7, the direction of the relative movement of the pin portion 553 and the guided track 40 starts to reverse and move in the second direction 91 due to the reverse force upon removal of the external force that moves the moving unit 2 in the first direction 93. At this state, the pin portion 553 enters and engages the restriction space 471 of one of the limit blocks 47 and the corresponding one of the auxiliary blocks 48, and the relative movement of the pin portion 553 and the guide track 40 stops in the limit path 402. As a result, the moving unit 2 is positioned in a half-closed state.

If the user desires to move the carrier member 21 from the half-closed state to a fully closed state, the front plate 211 may be pushed once again, such that the moving unit 2 is subjected to the external force once again. At this state, the relative movement of the pin portion 553 causes the pin portion 553 to return to the limit path 402 from the restriction space 471 and to continue the unidirectional movement along the route indicated using the dotted lines 94 until the moving unit 2 reaches the fully closed state as shown in FIG. 4.

If the user desires to move the carrier member 21 to the fully opened state from the half-closed state, the front plate 211 may be pulled by the user, such that the moving unit 2 is once again subjected to the reverse force or the restoring force of the resilient member 33. The reverse force causes the pin portion 553 to push the resilient portion 481 of an adjacent one of the auxiliary blocks 48, to squeeze through the adjacent evading gap 49, to enter the non-limit path 401 and to make the relative movement along the route indicated by the phantom lines 92 until the moving unit 2 reaches the fully opened state as shown in FIG. 2.

Figure 10:
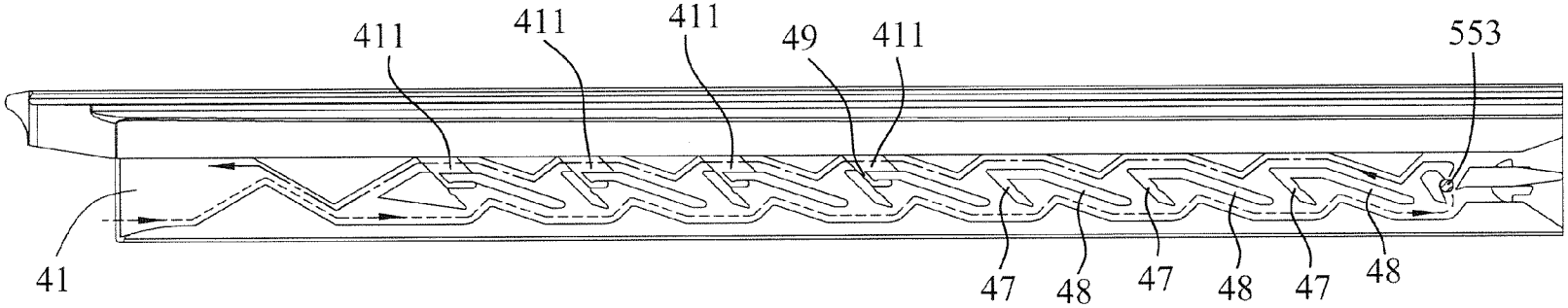
FIG. 10 is a fragmentary schematic side view of the second preferred embodiment of a movement restricting apparatus according to the present invention.

FIG. 10 illustrates the second preferred embodiment of a movement restricting apparatus according to this present invention, which has a structure generally similar to that of the first preferred embodiment. Unlike the previous embodiment, some of the limit blocks 47 and the corresponding blocks 48 are respectively connected to each other at the converging ends of the restriction spaces 471 thereof so that the evading gaps 49 (see FIG. 6) are not formed. Specifically, some of the limit blocks 47, which are disposed on the front part of the base wall 41 distal from the hollow portions 411 of the base wall 41 are each formed integrally as one piece with the respective auxiliary blocks 48, and do not provide the evading effect illustrated in FIG. 7.

Figure 11:
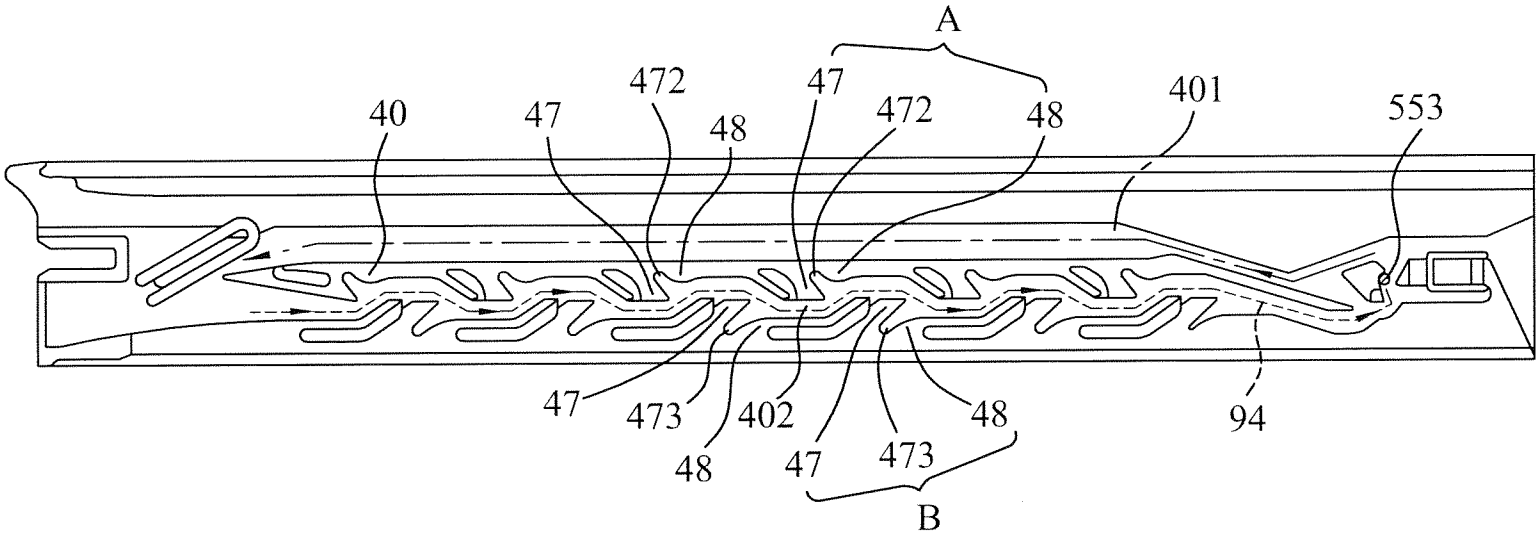
FIG. 11 is a fragmentary schematic side view of the third preferred embodiment of a movement restricting apparatus according to the present invention.
Figure 12:
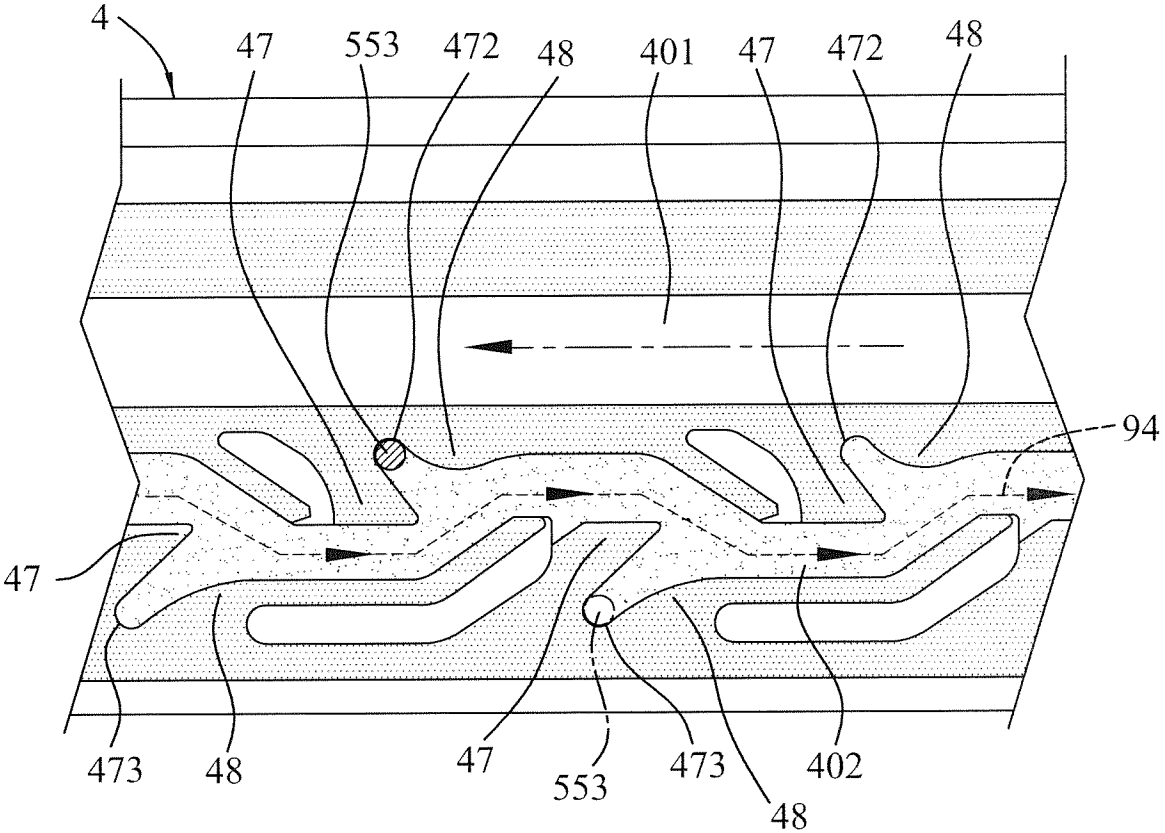
FIG. 12 is an enlarged view of a portion of the third preferred embodiment shown in FIG. 11, illustrating the position of the pin portion when the moving unit is in the half-closed state.

FIGS. 11 and 12 illustrate the third preferred embodiment of a movement restricting apparatus according to this present invention, which has a structure generally similar to that of the second preferred embodiment. However, in this embodiment, the guide track 40 of the track unit 4 has a plurality of upper limit units (A) that are spaced apart from each other in a front-rear direction and a plurality of lower limit units (B) that are spaced apart from each other in the front-rear direction. Each of the upper and lower limit units (A, B) has a limit block 47 and an auxiliary block 48. In this preferred embodiment, the limit block 47 of each upper limit unit (A) is disposed between the non-limit and limit paths 401, 402. The auxiliary block 48 of each upper limit unit (A) is disposed between the non-limit and limit paths 401, 402 and is located in proximity to and in front of the limit block 47. The limit block 47 of each lower limit unit (B) is disposed under the limit path 402. The auxiliary block 48 of each lower limit unit (B) is disposed under the limit path 402 and is located in proximity to and in front of the limit block 47 of the lower limit unit (B).

In the third preferred embodiment, the limit path 402 has a different configuration and is configured in such a manner that the route of the relative movement indicated using the phantom lines 94 forms a series of trapezoidal teeth. In order to enhance the effect of immobilizing the moving unit 2 in the half-closed state relative to the stationary unit 1, each upper limit unit (A) defines an upper receiving recess 472, and each lower limit unit (B) additionally defines a lower receiving recess 473. As shown in FIG. 12, during the closing operation of the moving unit 2, when the external force from the user is removed, if the pin portion 553 is at the position between two adjacent upper and lower receiving recesses 472, 473, in which the upper receiving recess 472 is behind the lower receiving space 473, the reverse force will cause the pin portion 553 to enter the upper receiving recess 472 (see the solid lines for the pin portion 553 in FIG. 12). On the other hand, if the pin portion 553 is at the position between two adjacent upper and lower receiving recesses 472, 473, in which the lower receiving recess 473 is behind the upper receiving space 472, the reverse force will cause the pin portion 553 to enter the lower receiving recess 473 (see the dotted lines for the pin portion 553 in FIG. 12). As the pin portion 553 enters the upper or lower receiving spaces 472, 473, the moving unit 2 is placed in the half-closed state. The closing operation of the carrier member 21 may be continued by applying the external force once again to the moving unit 2 to shift the relative movement of the pin portion 553 to the limit path 402 for continuing with the relative unidirectional movement along the route indicated using the phantom lines 94.

Figure 13:
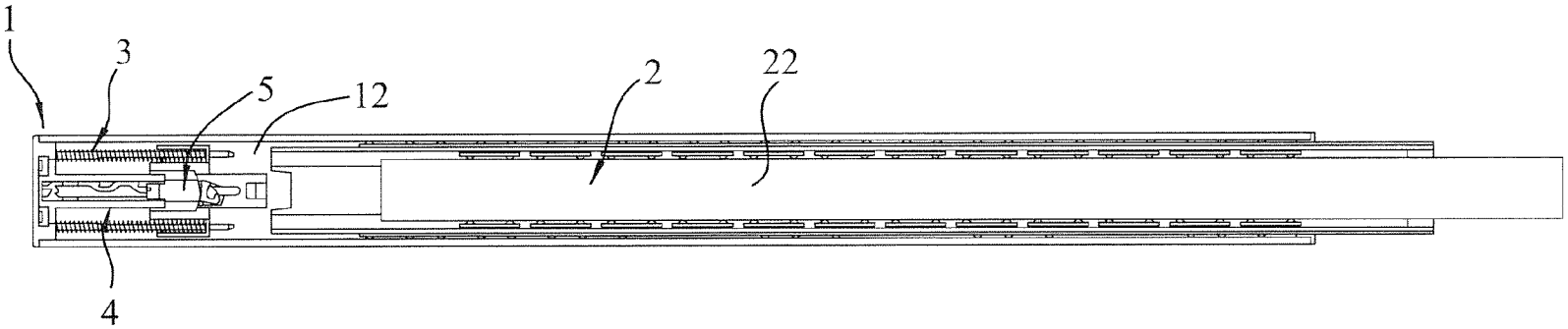
FIG. 13 is a schematic side view of the fourth preferred embodiment of a movement restricting apparatus according to the present invention.
Figure 14:
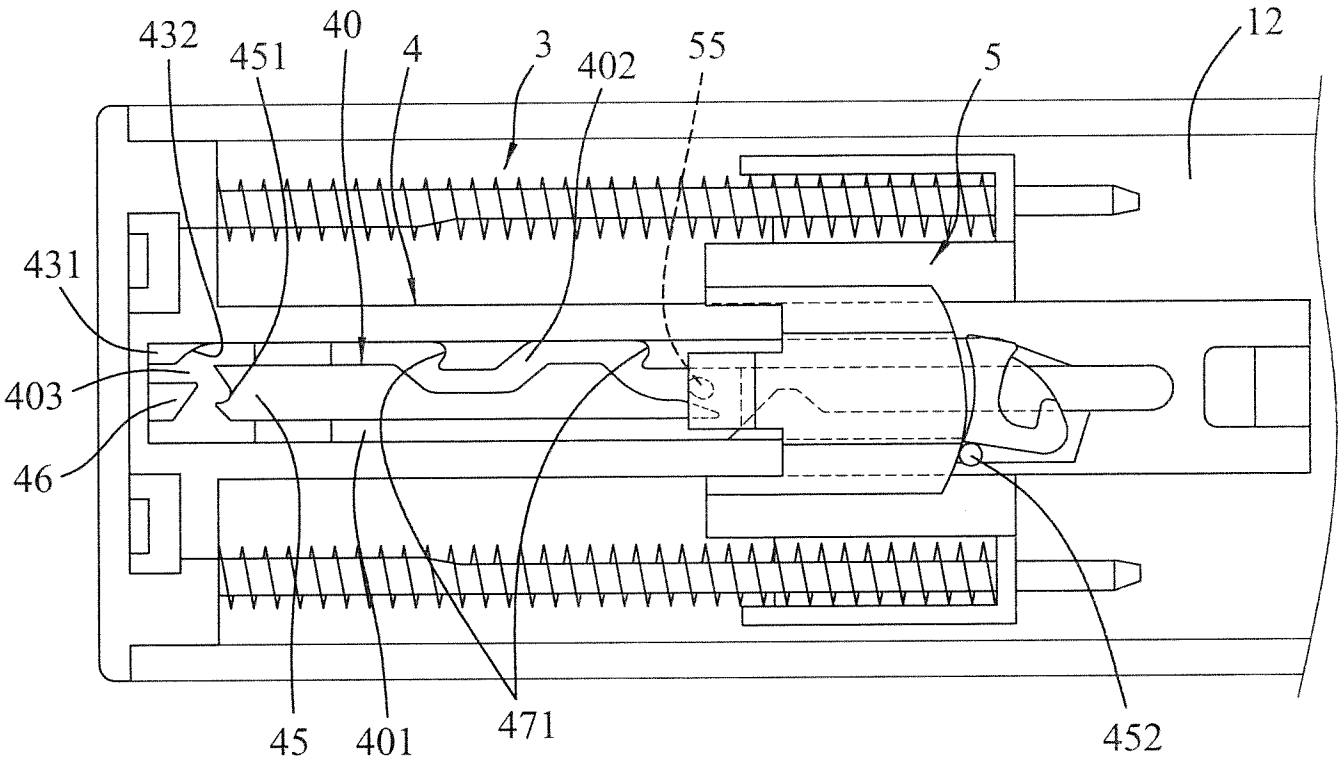
FIG. 14 is a fragmentary enlarged view of a portion of the fourth preferred embodiment.
Figure 15:
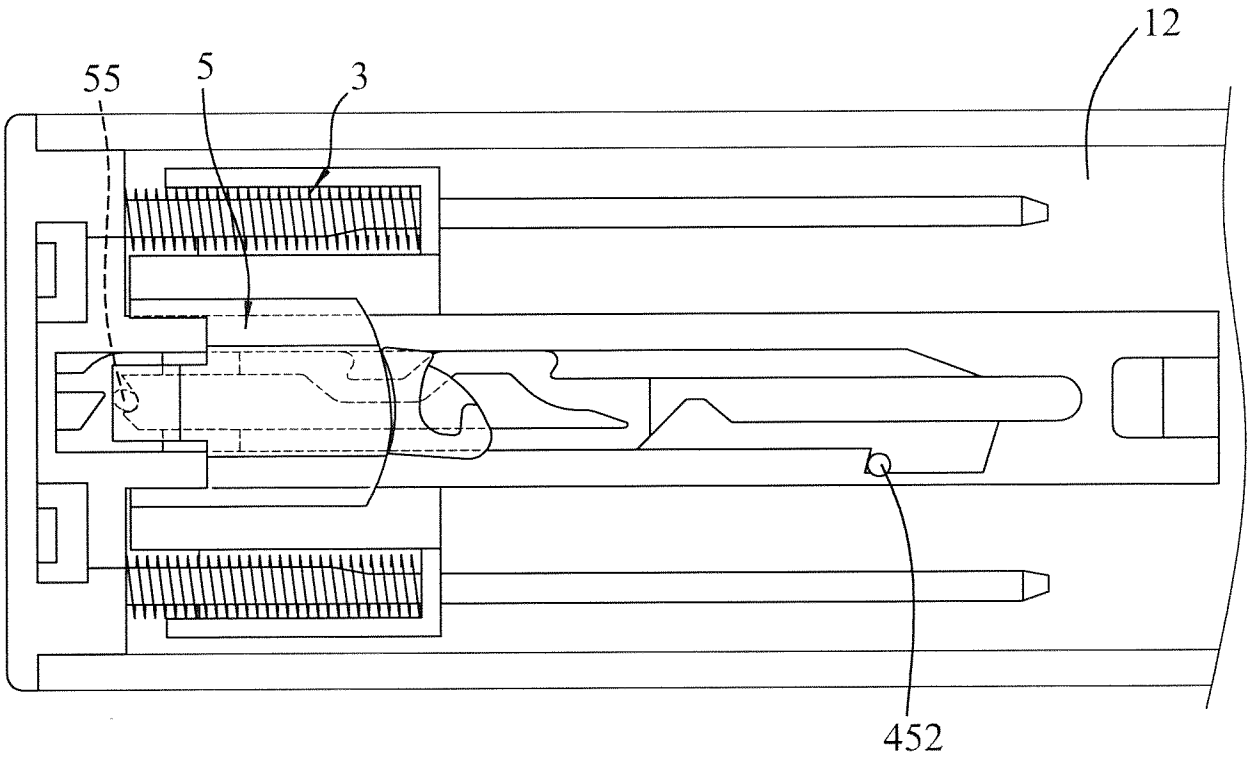
FIG. 15 is the same view as FIG. 14, but illustrating a retracted position of a sliding rail member.

Referring to FIGS. 13 and 14, a fourth preferred embodiment of the present invention differs from the previous embodiments in that the fourth preferred embodiment is disposed between the stationary rail member 12 and the sliding rail member 22, the track unit 4 is installed on a rear end portion of the stationary rail member 12, and further includes a front engaging pillar 452 disposed at a front end portion of the stationary rail member 12. The restricting unit 5 is mounted slidably on the track unit 4 to move forward or rearward and is disposed at the rear end of the sliding rail member 22, and the biasing unit 3 is disposed between the track unit 4 and the restricting unit 5. In use, the restricting unit 5 is actuated to move the pin portion 55 and to slide the sliding rail member 22 between an extended position shown in FIG. 14 and a retracted position shown in FIG. 15. This embodiment may also provide the effect of sliding the moving unit 2 (see FIG. 2) and the effect of instantaneously positioning the moving unit 2 during the sliding operation.

To sum up, by virtue of the design of the guide track 40, the relative movement of the pin portion 553 and the guide track 40 can be guided by the limit path 402 or the non-limit path 401 in the unidirectional manner. During the closing operation of the moving unit 2, if the external force to close the moving unit 2 is removed, the moving unit 2 may be stopped instantaneously by the biasing force of the biasing unit 3 when nearly reaching the closed position and may continue its movement to the fully closed or open position after the instantaneous stop without causing damage to the movement restricting apparatus. In addition, when there is a positional deviation between the movement restricting devices disposed at left and right sides, since the pin units 55 of the restricting units 5 are adjustable relative to the respective track units 4, the relative movements of the pin units 55 can be synchronized in the respective guide tracks 40, and the pin portions 553 may be positioned synchronously in the restriction space 471 in the respective limit path 402.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A movement restricting apparatus for installation in a slide assembly, the slide assembly including a stationary unit and a moving unit that is movable relative to the stationary unit, the movement restricting apparatus comprising:

a track unit adapted to be connected to one of the stationary unit and the moving unit, and including a longitudinal guide track, a front lock piece, a front eject piece proximate to said front lock piece, and a deflection block disposed between said front lock piece and said front eject piece, said guide track having a non-limit path, a limit path and a turning region, said front lock piece and said front eject piece being disposed at a junction of said non-limit path and said limit path, said front lock piece having a hook recess proximate to said front eject piece, said turning region being disposed between said front lock piece and said deflection block;

a restricting unit adapted to be connected to the other one of the stationary unit and the moving unit, and including an adjustment casing, a pin seat connected to said adjustment casing, and a pin unit pivotally mounted to said pin seat, said pin unit having a pin portion that is inserted swingably into said track unit; and a biasing unit having a resilient member adapted to be disposed between the stationary unit and the moving unit;

wherein said pin portion and said guide track make relative movement when the moving unit moves relative to the stationary unit;

wherein the relative movement of said pin portion and said guide track is guided unidirectionally by said limit path when the moving unit is moved by an external force in a first direction, and is guided by said non-limit path when the moving unit is urged by said biasing unit to move unidirectionally in a second direction opposite to the first direction;

wherein, when the relative movement of said pin portion and said guide track is guided by said limit path, said pin portion is engageable with said guide track to stop the relative movement of said pin portion and said guide track as soon as the direction of the relative movement of said pin portion and said guide track reverses due to a biasing force of said biasing unit upon removal of the external force that moves the moving unit in the first direction; and wherein: when the moving unit is once again subjected to the external force, the relative movement of said pin portion and said guide track continues in said limit path until said pin portion leaves said limit path and is guided into said turning region by said deflection block; when the external force is removed once again, the moving unit is subjected to the reverse biasing force of said biasing unit, and said pin portion is engaged in said hook recess of said front lock piece; when the moving unit is subjected to the external force once again, said pin portion is ejected from said hook recess into said non-limit path by said front eject piece; and when the external force is removed once again, said pin portion enters said non-limit path and the relative movement between said pin portion and said guide track is driven unidirectionally by the reverse biasing force of said biasing unit.

2. The movement restricting apparatus as claimed in claim 1, wherein said guide track has at least one restriction space adjacent to said limit path to engage said pin portion and to thereby restrict the relative movement of said pin portion and said guide track.

3. A movement restricting apparatus for installation between a stationary unit and a moving unit that is movable relative to the stationary unit, the movement restricting apparatus comprising:

a track unit including a longitudinal guide track that has a non-limit path and a limit path, said non-limit path and said limit path being spaced apart from each other and extending longitudinally of said guide track, said track unit further including at least one limit block that is disposed between said non-limit path and said limit path, and at least one auxiliary block that is disposed between said non-limit path and said limit path in proximity to said at least one limit block, said at least one limit block and said at least one auxiliary block extending convergingly to each other to cooperatively define a restriction space therebetween; and a restricting unit including a swingable pin unit that has a pin portion inserted swingably into said track unit;

wherein said pin portion and said guide track make relative movement when the moving unit is moved relative to the stationary unit;

wherein the relative movement of said pin portion and said guide track is guided by said limit path when the moving unit is moved by an external force in a first direction, and is guided by said non-limit path when the moving unit is moved by a reverse force in a second direction opposite to the first direction; and wherein, when the relative movement of said pin portion and said guide track is guided by said limit path, said pin portion is engageable with said restriction space to stop the relative movement of said pin portion and said guide track as soon as the direction of the relative movement of said pin portion and said guided track starts to reverse due to the reverse force upon removal of the external force that moves the moving unit in the first direction.

4. The movement restricting apparatus as claimed in claim 3, wherein said at least one limit block and said at least one auxiliary block are connected to each other.

5. A movement restricting apparatus for installation on a stationary rail member and a sliding rail member, the movement restricting apparatus comprising:

a track unit including a longitudinal guide track, a front lock piece, a front eject piece proximate to said front lock piece, and a deflection block disposed between said front lock piece and said front eject piece, said guide track having a non-limit path, a limit path, and a turning region, said front lock piece and said front eject piece being disposed at a junction of said non-limit path and said limit path, said front lock piece having a hook recess proximate to said front eject piece, said turning region being disposed between said front lock piece and said deflection block;

a restricting unit movable relative to said track unit and including a pin seat, and a pin unit that is pivotally mounted to said pin seat, said pin unit having a pin portion that is inserted swingably into said track unit; and a biasing unit having a resilient member adapted to be disposed between the stationary rail member and the sliding rail member;

wherein said pin portion and said guide track make relative movement when the sliding rail member moves relative to the stationary rail member;

wherein the relative movement of said pin portion and said guide track is guided unidirectionally by said limit path when the sliding rail member is moved by an external force in a first direction, and is guided by said non-limit path when the sliding rail member is urged by said resilient member to move unidirectionally in a second direction opposite to the first direction;

wherein, when the relative movement of said pin portion and said guide track is guided by said limit path, said pin portion is engageable with said guide track to stop the relative movement of said pin portion and said guide track as soon as the direction of the relative movement of said pin portion and said guided track reverses due to a reverse biasing force of said biasing unit upon removal of the external force that moves the sliding rail member in the first direction;

wherein: when the sliding rail member is once again subjected to the external force, the relative movement of said pin portion and said guide track continues in said limit path until said pin portion leaves said limit path and is guided into said turning region by said deflection block; when the external force is removed once again, the sliding rail member is subjected to the reverse biasing force of said biasing unit, and said pin portion is engaged in said hook recess of said front lock piece; when the sliding rail member is subjected to the external force once again, said pin portion is ejected from said hook recess into said non-limit path by said front eject piece; and when the external force is removed once again, said pin portion enters said non-limit path and the relative movement between said pin portion and said guide track is driven unidirectionally by the reverse biasing force of said biasing unit.

6. The movement restricting apparatus as claimed in claim 5, wherein said guide track has at least one restriction space adjacent to said limit path to engage said pin portion and to thereby stop the relative movement of said pin portion and said guide track.

* * * * *